United States Patent [19]

Stahlecker

[11] 4,043,106

[45] Aug. 23, 1977

[54] OPEN-END SPINNING MACHINE WITH A TRAVELLING MAINTENANCE UNIT

[75] Inventor: Fritz Stahlecker, Bad Uberkingen, Germany

[73] Assignees: Fritz Stahlecker; Hans Stahlecker, both of Germany

[21] Appl. No.: 598,071

[22] Filed: July 22, 1975

[30] Foreign Application Priority Data

Aug. 8, 1974 Germany ..... 2438168

[51] Int. Cl.[2] ..... D01H 1/12; D01H 13/16

[52] U.S. Cl. ..... 57/34 R; 57/58.95

[58] Field of Search ..... 57/34 R, 53–54, 57/58.89, 58.95, 156

[56] References Cited

U.S. PATENT DOCUMENTS

| | | | |
|---|---|---|---|
| 3,672,143 | 6/1972 | Whitney | 57/34 R X |
| 3,695,017 | 10/1972 | Hori et al. | 57/34 R |
| 3,735,262 | 5/1973 | Orth | 57/34 RX |
| 3,789,595 | 2/1974 | Bernstein et al. | 57/34 R |
| 3,810,352 | 5/1974 | Miyazaki et al. | 57/34 R |
| 3,877,209 | 4/1975 | Seidl et al. | 57/34 R |
| 3,902,308 | 9/1975 | Bernstein et al. | 57/34 R |
| 3,943,689 | 3/1976 | Kunz et al. | 57/34 R |

*Primary Examiner*—Richard C. Queisser
*Assistant Examiner*—Charles Gorenstein
*Attorney, Agent, or Firm*—Craig & Antonelli

[57] ABSTRACT

In order to be able to call a maintenance unit to a spinning point requiring maintenance in an open-end spinning machine comprising a plurality of spinning points, this spinning point provides a signal which can be recognized by a detector of the maintenance unit. The signal transmitter required herefor is connected with the sliver supply means, which are stopped in the event of a malfunction at the spinning point requiring maintenance. The signal transmitter therefore indicates the stopped condition of these means, which is recognized by the detector.

18 Claims, 10 Drawing Figures

Fig.3
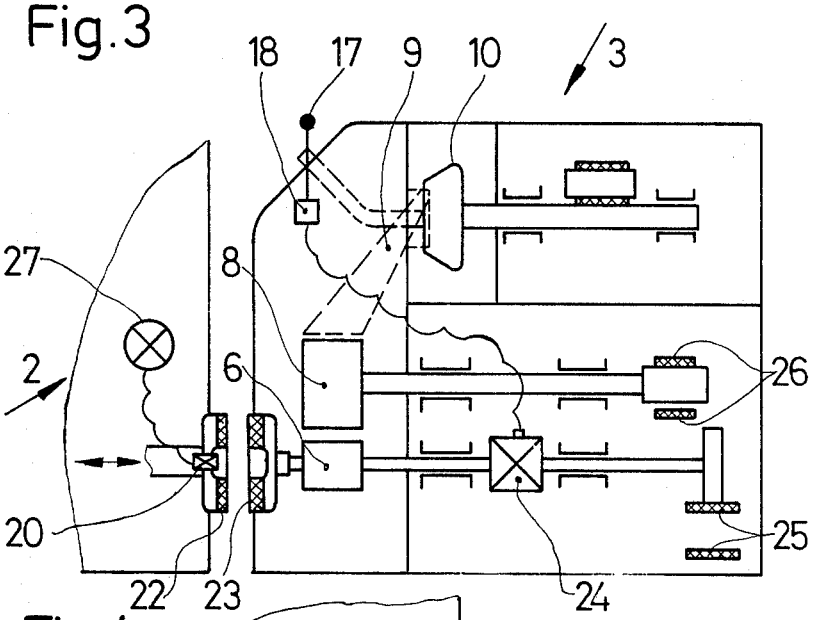
Fig.4
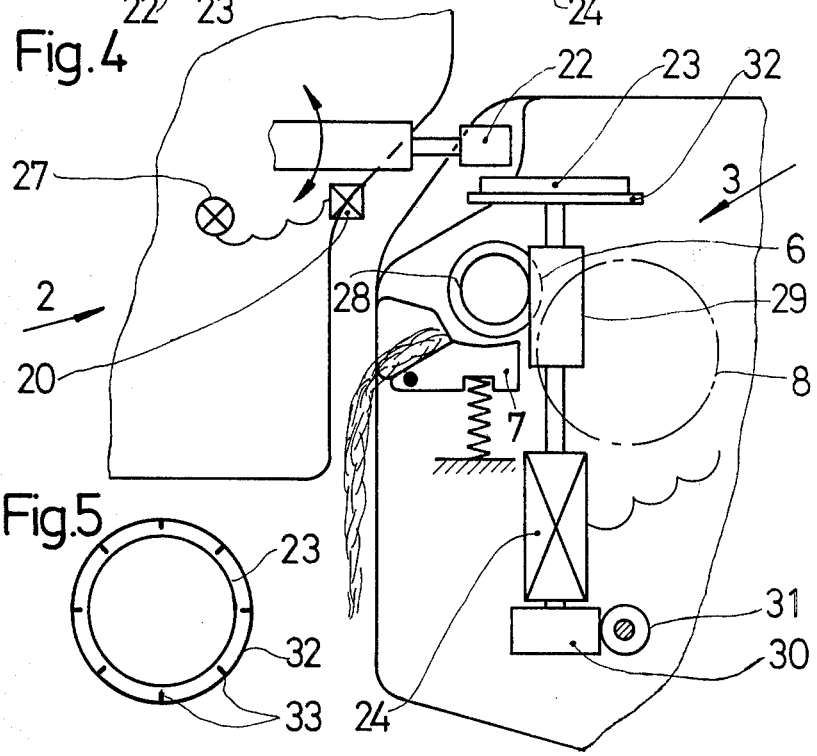
Fig.5

Fig. 8A
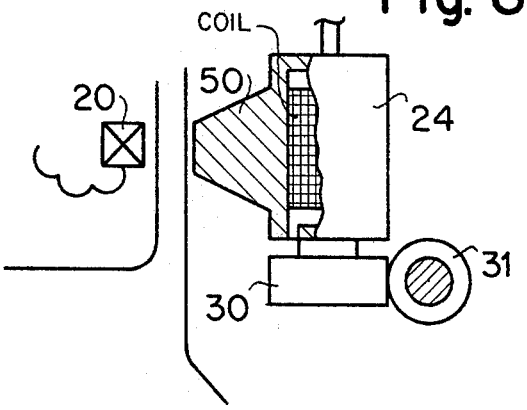
Fig. 8
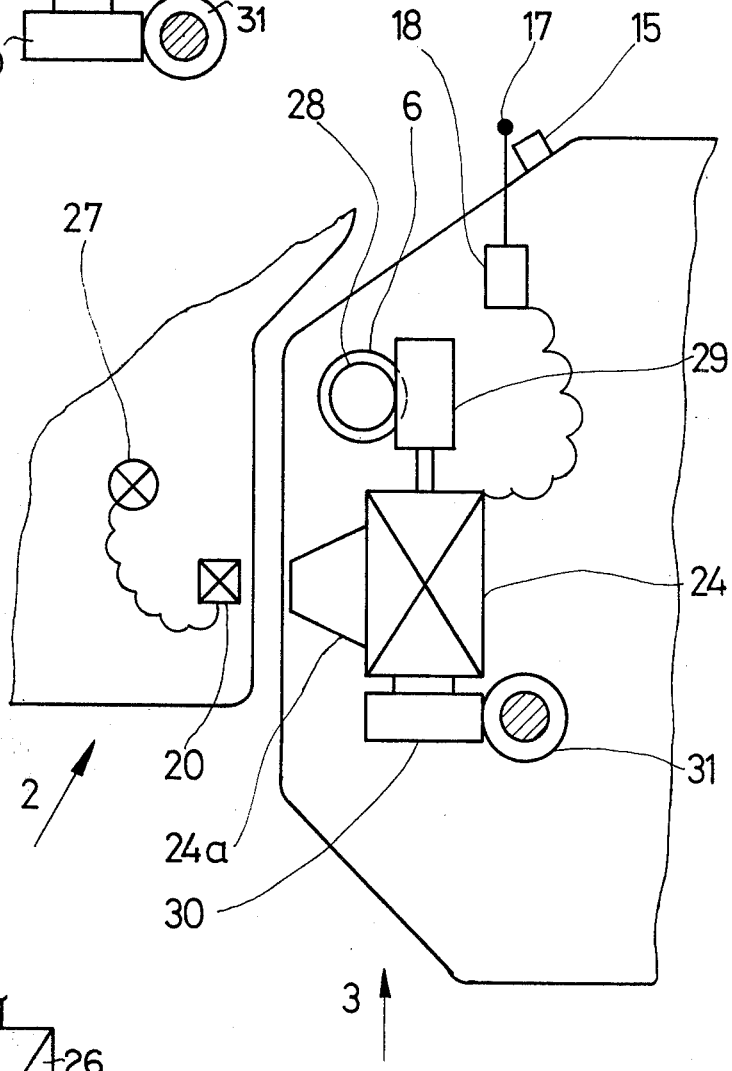
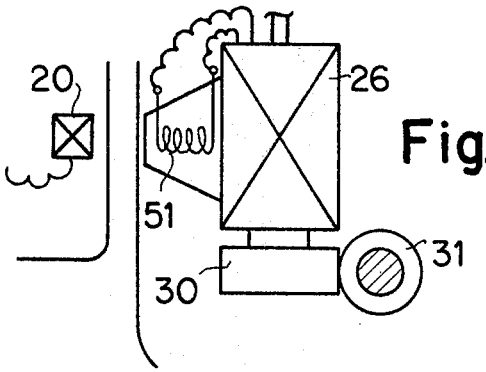
Fig. 8B

OPEN-END SPINNING MACHINE WITH A TRAVELLING MAINTENANCE UNIT

The present invention relates to an open-end spinning machine having a plurality of spinning points and at least one maintenance unit travelling to the spinning points, with each of the spinning points containing one means for switching off sliver supply means in the event of a malfunction.

Open-end spinning machines with travelling maintenance units are known and are preferably employed for remedying a thread break and for start-spinning again (U.S. Pat. No. 3,640,059, German Published Patent Application No. 2,008,142, German Pat. No. 2,012,108, German Disclosed Patent Application No. 2,133,135 and German Disclosed Patent Application No. 2,118,775). In these known designs, the open-end spinning machine is equipped with sliver supply means which are interrupted in the event of a thread break or if a weak point or similar defect is found in the thread. How the maintenance unit determines that there is a malfunction at a given spinning point, at which a maintenance process is then to be performed, is not described in more detail in these designs.

However in spinning and twisting machines of a different type there are numerous examples of how the need for maintenance of a spinning point of a spinning machine is determined. For example, it is known practice to provide a wandering thread break indicator (British Pat. No. 1,113,123), which mechanically feels the threads. In another design (U.S. Pat. No. 3,751,893), a feeler feels the thread. Under normal operating conditions, the vibrations to which the feeler is subjected cause an electrical signal to be given to an electronic switch, whereby the maintenance unit only is actuated if this signal is missing. It is also known practice (German Disclosed Patent Application No. 2,163,197) to provide a photoelectric scanning device for the thread in conjunction with a carriage which can be shifted along a spinning machine. In a further known design (British Pat. No. 1,323,430) the presence of a thread is recognized by optical means, which are then converted to electrical pulses and advanced to the wandering maintenance unit.

All known designs are based on a common basic principle, which can be viewed as checking for the presence of the spun thread, for which purpose the thread is felt by a travelling device attached to the maintenance unit. This method of operation requires that the thread be readily accessible and that the thread always assume the same position wherever possible and, in particular, not traverse in the longitudinal direction of the machine. With an optical scanning device, in addition, it is also necessary for the thread to be as free as possible of fibre fly, as the fibre fly could otherwise simulate the presence of a thread. These conditions cannot readily be complied with in open-end spinning machines, and the individual spinning points, and thus the individual threads to be felt or scanned, are located at relatively great distances one from the other, so that in effect the presence of a thread can only be recognized with mechanical means.

It is the object of the present invention to notify the maintenance unit of a malfunction at an openend spinning point, in particular a thread break, without having to attach a feeling or scanning device for the thread to the maintenance unit. According to the present invention, this object is solved in that each spinning point, which switches off the sliver supply means, also contains a signal transmitter which is actuated jointly with the sliver supply means and which gives or returns a signal for a detector located at the maintenance unit.

This solution utilizes the fact that each spinning point is already equipped with members which respond to a thread break or similar malfunction anyway, so that the additional effort required for equipping each spinning point with a signal transmitter can be kept within relatively small limits. Mechanical, optical or electrical methods, or combinations thereof, can be employed, whereby the member at each spinning point can be designed in an extremely simple manner.

The above discussed and other objects, features and advantages of the present invention will become more apparent from the following description thereof, when taken in connection with the accompanying drawings, in which FIG. 1 shows a top view of an open-end spinning machine having two maintenance units;

FIGS. 3 and 4 show sections through further embodiments similar to that shown in FIG. 2;

FIG. 5 shows a development of a detail of FIG. 4;

FIG. 8 shows a section through a spinning point whose fibre supply means are equipped with an electromagnetic clutch and FIGS. 8A and 8B are partial schematic views showing modifications of the FIG. 8 embodiment.

Figure 1:
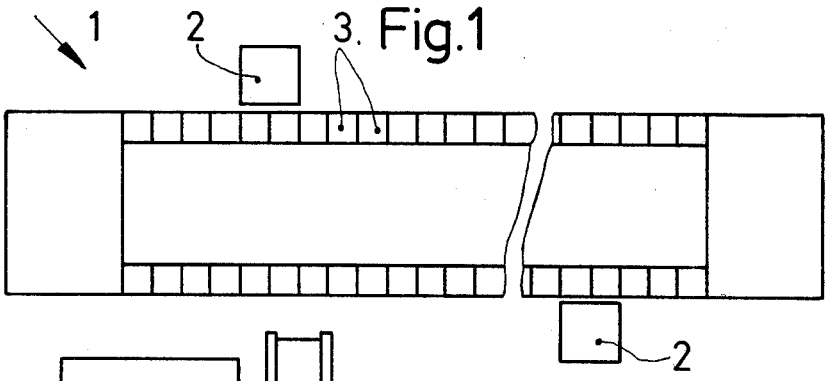
Figure 2:
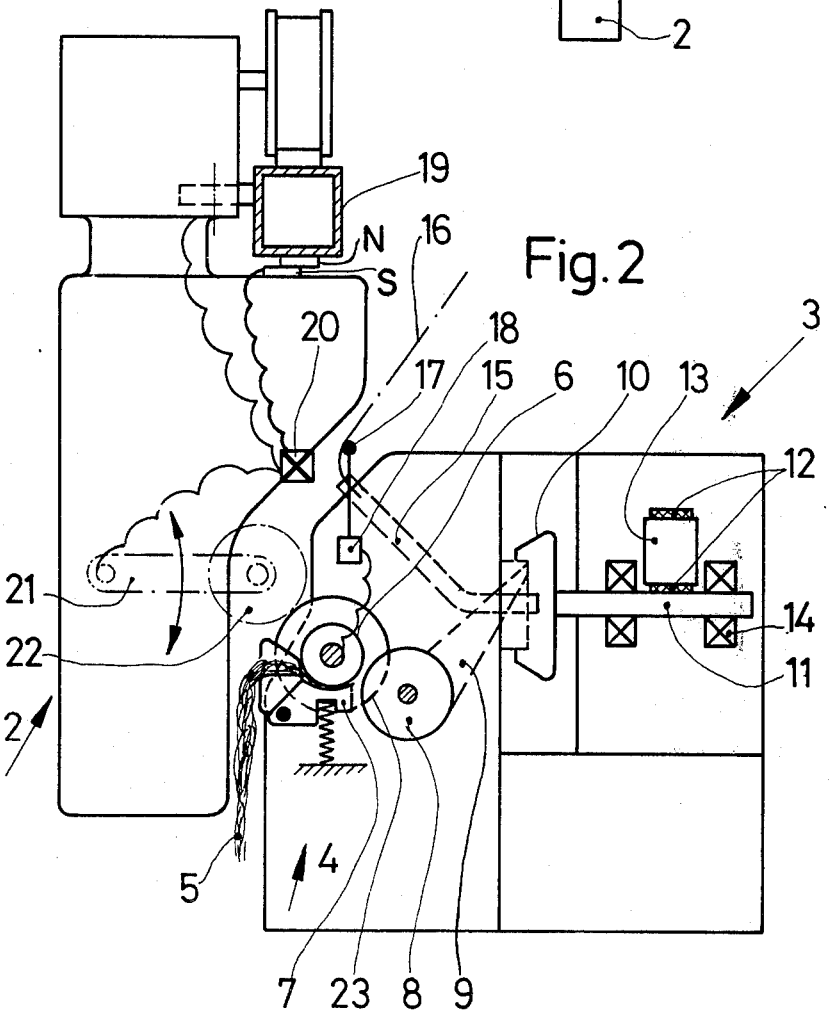
FIG. 2 shows a section through the open-end spinning machine in the area of a spinning point, with a maintenance unit positioned therebefore.

Referring now to the drawings, wherein like reference numerals designate like parts throughout the several views, FIG. 1 shows a schematic representation of an open-end spinning machine 1 which, viewed from above, contains a number of spinning points 3 disposed along both longitudinal sides. Arranged in a travelling manner along each side of open-end spinning machine 1 is a maintenance unit 2, which is schematically illustrated as a section in FIG. 2. Among other things, spinning point 3 contains supply means 4, which supply a sliver 5 to be spun to a high-speed opener roller 8 by means of a supply roller 6 operating conjointly with a pressure element 7, which is subjected to the force of a spring. Sliver 5 is opened into individual fibres by opener roller 8, with the individual fibres 8 advancing to a spinning rotor 10 by means of a fibre channel 9. The shaft 11 of spinning rotor 10 is mounted in bearings 14 and, in the present example, is driven by means of a tangential belt 12, which is pressed against rotor shaft 11 by means of a pressure pulley 13. The yarn spun in spinning rotor 10 is drawn off through a yarn removal channel 15. The thread 16, represented by a dash-dotted line, is in a contacting relationship with a thread stop-motion 17, which is tensioned by the thread tension and which assumes a different position in the event of a thread break. It actuates a switch 18, which is electrically connected with a clutch arranged on the shaft of supply roller 6. In the event of a thread break, supply roller 6 can thus be stopped.

Maintenance unit 2 is shiftably guided on a rail 19 extending along open-end spinning machine 1. This maintenance unit 2, e.g. a device for remedying a thread break and for start-spinning, has a detector 20, which can operate either optically, electrically, pneumatically or mechanically, in a known manner. As schematically indicated, maintenance unit 2 has a swivelable and drivable wheel 22, which can be placed in a contacting relationship with a wheel 23 arranged on the shaft of supply roller 6. In this manner, maintenance unit 2 can temporarily drive supply roller 6, which is stopped in the event of a thread break, for the purpose of remedying this thread break. As long as thread 16 assumes its normal position, drive wheel 23 rotates together with supply roller 6. As maintenance unit 2 passes by spinning point 3, detector 20 recognizes this rotation. If drive wheel 23 has stopped as the result of a malfunction, detector 20 recognizes this and gives a command for stopping maintenance unit 2 at spinning point 3, on the one hand, as well as additional signals for the actuation of the maintenance unit, e.g. for swivelling drive wheel 22 into position for example, on the other. The individual operations of a maintenance unit of this type will not be discussed here, as they are not of significance for the invention. It is practical to provide additional means for automatically locating maintenance unit 2 in a precisely defined position relative to the spinning point.

In the embodiment according to FIG. 3, opener roller 8 is driven by means of a tangential belt 26 and supply roller 6 by means of a toothed belt 25. Here, also, the opened fibres are advanced to spinning rotor 10. Connected to the drive shaft of supply roller 6 is an electromagnetic clutch 24, which is electrically connected with switch 18 of thread stop-motion 17. In the event of a thread break, this electromagnetic clutch 24 stops supply roller 6, and thus also a drive wheel 23, which is accessible from the outside. Detector 20, located on maintenance unit 2 passing by, can recognize this stopped condition of drive wheel 23 and gives a command to a control point 27, which causes the maintenance unit to stop at spinning point 3 and to remedy the malfunction in accordance with a stipulated programme. In this connection, one of the possibilities is for a drive wheel 22, which is located on the maintenance unit and equipped with an auxiliary drive, to be moved toward drive wheel 23, located at spinning point 3, in the direction of the arrow.

In the embodiment according to FIG. 4, supply roller 6 is driven by a helical gear 29 via a gear 28. This helical gear 29, in turn, is driven by a further helical gear 30, which meshes with a driven gear 31, whose shaft extends along the open-end spinning machine. Located between helical gear 30 and helical gear 29 is an electromagnetic clutch 24, which is electromagnetically controlled by a thread stop-motion in an unillustrated manner. Here, also, supply roller 6 is stopped in the event of a thread break. Connected rigidly with the shaft of helical gear 29 is a drive wheel 23, which therefore rotates conjointly with helical gear 29 in the normal operating condition and which stops in the event of a malfunction. This drive wheel 23, or more precisely the collar 32 coupled thereto, is scanned by a detector 20 of maintenance unit 2. This collar 32 of drive wheel 23 can (FIG. 5) have small magnets 33 disposed along its periphery, which provide pulses to detector 20 when drive wheel 23 rotates. Detector 20, which can be designed in any desired manner, can recognize the fact that these pulses are not being provided, and thus signal the presence of a malfunction to control point 27. Maintenance unit 2 then receives a command to stop at spinning point 3 and remedy the malfunction. In this case, it is possible for a drive wheel 22, located on maintenance unit 2, to swivel toward drive wheel 23 of spining point 3 in the direction of the arrow. It is also possible, for example, for collar 32 of wheel 23 to be equipped with toothing or similar means having differing reflection properties, which is then optically scanned with a reflex scanning unit. In this embodiment, also, a uniform signal is provided instead of a modulated signal in the event that wheel 23 has stopped.

Figure 6:
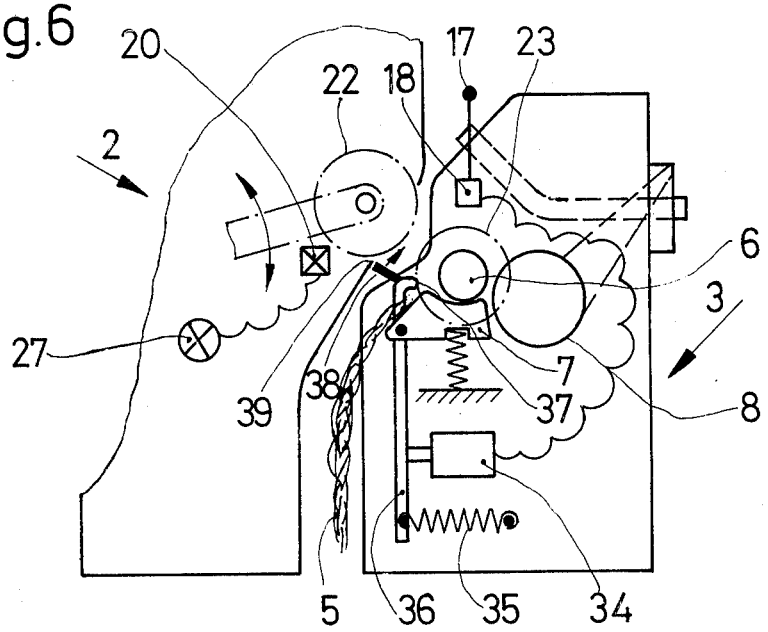
FIG. 6 shows a section through a partially illustrated spinning point of an open-end spinning machine in the area of a supply means.

The embodiment according to FIG. 6 contains a trapper 36, whose nose 37 presses the supplied sliver 5 against pressure element 7 in the event of a thread break, thereby trapping it. In the normal operating condition, this pressure element 7 operates conjointly with supply roller 6 and offers sliver 5 to an opener roller 8. In the event of a thread break, thread stop-motion 17 responds and actuates an operating magnet 34 by means of its switch 18. Against the force of a tension spring 35, operating magnet 34 presses trapper 36, or more precisely its nose 37, against sliver 5. Connected with this trapper 36 is a lever 38, which cannot be recognized by detector 20, located in maintenance unit 2, in the normal operating condition, as it is then located below the edge 39 of the housing of maintenance unit 2. Only in the event of a thread break, i.e. when trapper 36 has swivelled into operation, can this lever 38 be recognized by detector 20 since it is then raised above edge 39, so that the malfunction can be signalled to control point 27 by detector 20. In this embodiment, it is possible for supply roller 6 to continue to rotate in the event of a malfunction.

Figure 7:
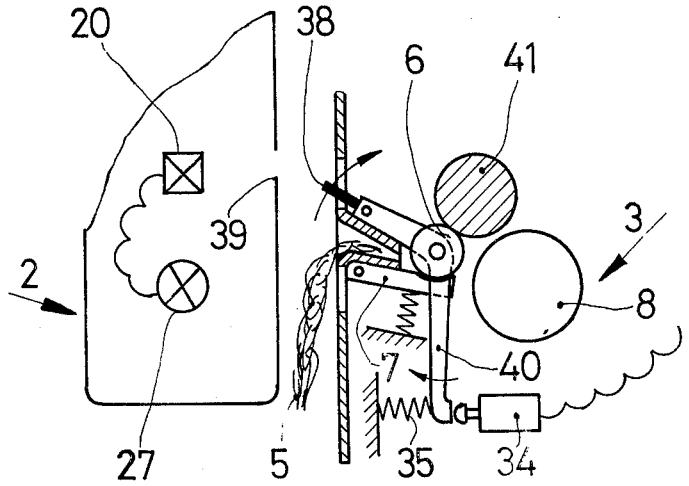
FIG. 7 shows a section through a spinning point similar to that shown in FIG. 6.

In the embodiment according to FIG. 7, supply roller 6 is driven by a drive shaft 41 in the normal operating condition. In the event of a thread break, it can be swivelled away by a two-arm lever 40 by means of operating magnet 34, controlled by the thread stop-motion. This swivel motion of two-arm lever 40 is transmitted to a further lever 38 which is normally concealed below edge 39 of maintenance unit 2. In the event of a malfunction, however, lever 38 swivels out to the top upwardly and can be recognized by detector 20. In this manner, the detector, which can be designed in any desired manner, can recognize the malfunction and signal control point 27. It should be expressly pointed out that any desired type of known detector can be employed for the invention. For example, the signals can be given and received mechanically if every spinning point 3 is equipped with a shift finger, which swivels into an area in which it can actuate the shift button of a switch arranged on the maintenance unit passing by if the sliver supply means stop. Each spinning point 3 can also be equipped with a light source associated to a photoelectric cell of the maintenance unit which serves as the detector. It is practical for the light source to be supplied with electric current as long as the sliver supply means are operating, as malfunctions in the circuitry of the light source can then also be recognized.

In order to prevent detector 20 from receiving incorrect signals if maintenance unit 2 is located between two spinning points, for example, it is practical for detector 20 to only respond if it receives additional information regarding the position of maintenance unit 2. This can be realized in a simple manner by providing an index notch N for each spinning point on rail 19, which is then recognized by a roller lever switch S of the maintenance unit. It would then be possible for the roller lever switch S to then only switch detector 20 to RECEIVE when the index notch N is recognized.

In the same manner as the embodiment according to FIG. 4, in the embodiment according to FIG. 8 the drive of supply roller 6 also contains an electromagnetic clutch 24, which is disengaged by thread stop-motion 17 in the event of a thread break or similar malfunction. In this embodiment, detector 20 of maintenance unit 2 recognizes a signal which is sent by a signal transmitter which is electrically connected with the energization of the coil of clutch 24. It is possible to design detector 20 in such a manner that energization of clutch 24 serves as a direct signal. It is also possible for the magnetic field of clutch 24, which then forms the signal, to be reinforced by a pole shoe (50, FIG. 8A) aligned toward detector 20 or by an auxiliary magnet 24*a*. However it would also be possible to provide a further transmitting coil (51, FIG. 8B), arranged as closely to the path of travel of detector 20 as possible, as a signal transmitter, which is connected either in parallel or in series with the magnet coil of clutch 24. It is also possible for each spinning point to be associated to a light-emitting diode, located in the infrared range for example, which is connected in parallel with the magnet coil of clutch 24 of the respective spinning point, so that it lights up in the event of a thread break. Moreover, it is also possible to also apply the d.c. voltage applied to the magnet coil of clutch 24 in the event of a thread break to contacts arranged on the outside, e.g. on the cover of the spinning point, which are then scanned by a detector 20 of the maintenance unit designed as a slider.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. An open-end spinning machine having a plurality of spinning points each including a sliver supply means, and at least one maintenance unit travelling to said spinning points, said at least one maintenance unit including a detector means for detecting an operating position of the respective sliver supply means, each of said spinning points including a means for switching off said sliver supply means in the event of a malfunction and a signal transmitter, said signal transmitter being directly responsive to the operation of said sliver supply means and providing a signal of the operating position of the sliver supply means to the detector means located at said maintenance unit.

2. The open-end spinning machine according to claim 1, wherein said signal transmitter is a rotatably arranged component driven by said sliver supply means, said rotatably arranged component being mounted at the spinning point so as to be visible from outside of the spinning machine.

3. The open-end spinning machine according to claim 2, wherein said at least one maintenance unit further includes an auxiliary drive, and wherein said rotatably arranged component is a wheel, said signal transmitter forms a unit mounted at each spinning point so as to be accessible from outside of the spinning machine, and said wheel being selectively coupled with said auxiliary drive of the maintenance unit in response to a signal of said signal transmitter.

4. The open-end spinning machine according to claim 3, wherein permanent magnets are disposed along the periphery of said wheel for providing a signal to said detector means of an operating position of the spinning point.

5. The open-end spinning machine according to claim 1, wherein said means for switching off said sliver supply means includes a pivotal member provided at each spinning point for stopping said sliver supply means, and wherein said signal transmitter includes a signal member connected to said pivotal member and pivotable therewith into a position located opposite the detector means of the maintenance unit travelling by the respective spinning points when said pivotal member stops said sliver supply means.

6. The open-end spinning machine according to claim 1, wherein said sliver supply means includes an electromagnetic clutch which disengages in the event of a thread break, said electromagnetic clutch being arranged at the spinning point such that an operating condition thereof is directly detectable by said detector means of the maintenance unit as said maintenance unit travels by the respective spinning points.

7. The open-end spinning machine according to claim 6, wherein an energization of said electromagnetic clutch serves as a direct signal to said detector means of the maintenance unit that a malfunction has occurred at the spinning point.

8. The open-end spinning machine according to claim 6, wherein said detector means of the maintenance unit detects the magnetic field of said electromagnetic clutch.

9. The open-end spinning machine according to claim 8, wherein a pole shoe means at said electromagnetic clutch is aligned with said detector means so as to reinforce the magnetic field of said electromagnetic clutch.

10. The open-end spinning machine according to claim 8, wherein an auxiliary magnet means is provided at said electromagnetic clutch for reinforcing the magnetic field thereof.

11. The open-end spinning machine according to claim 7, wherein said signal transmitter is a transmitting coil arranged at the electromagnetic clutch.

12. An open-end spinning machine according to claim 1, wherein said sliver supply means includes a trapper means for trapping a sliver in the event of a thread break, said signal transmitter including means operatively connected with said trapper means for providing a signal to said detector means upon the occurrence of a thread break.

13. An open-end spinning machine according to claim 12, wherein said means for providing a signal includes a pivotally mounted lever having a first portion concealed from said detector means and a second portion in alignment with said detector means, and wherein means are provided for displacing said lever from said first portion to said second portion upon the occurrence of a thread break.

14. An open-end spinning machine according to claim 1, including a sliver supply roller means, a thread stop motion means, means for mounting said supply roller means so as to be pivotable from a normal operating position to an inoperable position, and means operatively connecting said thread stop motion means with said supply roller means so that said supply roller means is pivoted to the inoperative position upon the occurrence of a thread break, and wherein said signal transmitter includes means operatively connected with said supply roller means for providing a signal to said detector means when said supply roller means is in the operative position.

15. An open-end spinning machine according to claim 14, wherein said means for providing a signal includes a pivotally mounted lever connected to said mounting means for said supply roller means, said pivotally mounted lever having a first position concealed from said detector means and a second position in alignment with said detector means.

16. An open-end spinning machine according to claim 15, wherein said mounting means for said supply roller means includes a two armed lever means with said lever providing the signal to said detector means being arranged on one arm of said two armed lever means.

17. An open-end spinning machine according to claim 16, wherein said means operatively connecting said thread stop motion means with said supply roller means includes an electromagnetic means acting upon the other arm of said two armed lever means to displace said supply roller means to an inoperative position upon the occurrence of a thread break.

18. An open-end spinning machine according to claim 1, wherein means are provided at each spinning point for preventing the detector means from receiving incorrect signals.

* * * * *